US006610618B1

(12) United States Patent
Bottger et al.

(10) Patent No.: US 6,610,618 B1
(45) Date of Patent: Aug. 26, 2003

(54) PENETRATION-RESISTANT MATERIAL COMPRISING FABRIC WITH HIGH LINEAR DENSITY RATIO OF TWO SETS OF THREADS

(75) Inventors: Christian Bottger, Remscheid (DE); Achim Fels, Wuppertal (DE); Barbel Dorloff-Lumpe, Wuppertal (DE); Christoph Baumgart, Wuppertal (DE)

(73) Assignee: Teijin Twaron GmbH, Wuppertal (DE)

( * ) Notice: Subject to any disclaimer, the term of this patent is extended or adjusted under 35 U.S.C. 154(b) by 0 days.

(21) Appl. No.: 09/868,057

(22) PCT Filed: Jan. 12, 2000

(86) PCT No.: PCT/EP00/00290

§ 371 (c)(1),
(2), (4) Date: Aug. 30, 2001

(87) PCT Pub. No.: WO00/42246

PCT Pub. Date: Jul. 20, 2000

(30) Foreign Application Priority Data

Jan. 18, 1999 (EP) ..... 99200097
Feb. 22, 1999 (EP) ..... 99200492

(51) Int. Cl.[7] ..... B32B 5/26

(52) U.S. Cl. ..... 442/239; 442/134; 442/135; 442/246; 442/261; 442/286; 442/301; 428/105; 428/107; 428/111; 428/113; 428/911; 2/2.5

(58) Field of Search ..... 442/134, 135, 442/239, 246, 261, 286, 301; 428/105, 107, 111, 113, 911; 2/2.5

(56) References Cited

U.S. PATENT DOCUMENTS 5,187,003 A 2/1993 Chitrangad
5,198,280 A * 3/1993 Harpell et al. ..... 428/102
5,229,199 A 7/1993 Miner et al.
5,275,873 A 1/1994 Chitrangad
5,789,327 A 8/1998 Rousseau
5,960,470 A * 10/1999 Bachner, Jr. ..... 2/2.5
5,976,996 A * 11/1999 Howland ..... 442/189

FOREIGN PATENT DOCUMENTS

EP 0 310 199 4/1989
EP 0 851 203 A2 7/1998
RU 2 096 542 11/1997

OTHER PUBLICATIONS

Derwent Publications Ltd., AN 98–320748.

* cited by examiner

*Primary Examiner*—Elizabeth M. Cole
*Assistant Examiner*—Norca L. Torres
(74) *Attorney, Agent, or Firm*—Oliff & Berridge, PLC

(57) ABSTRACT

The invention pertains to a penetration-resistant material having at least a double layer of fabric composed of two layers of woven fabric which are cross-plied at an angle, characterized in that the fabric is composed of a first set of threads having 3.5 to 20 threads/cm and having a linear density of at least 420 dtex, and a second set of threads having 0.5 to 8 threads/cm and having a linear density of at least 50 dtex, with the second set of threads being transverse to the first set of threads, and wherein the ratio of the linear density of the first set of threads to the linear density of the second set of threads is >4.2, more preferably >7.5. In a preferred embodiment, the first set of threads is warp threads made of p-aramid yarn and the second set of threads is weft threads of polyester yarn, and the ratio of the number of threads/cm of the first set to that of the second set is >1.

17 Claims, No Drawings

PENETRATION-RESISTANT MATERIAL COMPRISING FABRIC WITH HIGH LINEAR DENSITY RATIO OF TWO SETS OF THREADS

BACKGROUND OF THE INVENTION

The invention pertains to penetration-resistant material comprising a fabric with high linear density ratios of two sets of threads, and to articles made of the same.

DESCRIPTION OF THE RELATED ART

Penetration-resistant articles such as bulletproof vests, helmets, vehicle panels, and shields prepared from high strength fibers are known in the art. For many applications, in particular for ballistic vests, the fibers are used in a woven or knitted fabric. These fabrics may be coated or impregnated in a matrix to obtain hard ballistic materials, or may be used free from matrix to obtain soft ballistic materials. Bulletproof woven fabrics are known, inter alia, from EP 310,199. The fabrics disclosed therein are composed of filament yarns of ultrahigh molecular weight polymer having high strength and high modulus, with the warp threads being of a different polymeric material than the weft threads. In Russian patent RU 2,096,542 a ballistic fabric for bulletproof jackets was disclosed having warp and weft threads of poly para-phenyleneterephthalamide (PPTA) wherein the ratio of warp to weft linear density is smaller than 4.17. Typically, warp threads having a linear density of 143 to 588 dtex and weft threads having a linear density of 588 to 930 were disclosed, the weft threads having equal or higher linear density than the warp threads. It is particularly contended that ballistic fabrics having warp to weft linear density ratios between 1.59 and 4.17 have improved deflection properties.

SUMMARY OF THE INVENTION

It has now been found that penetration-resistant materials comprising at least a double layer of fabric composed of two layers of woven fabric which are cross-plied at an angle, characterized in that the fabric is composed of a first set of threads comprising 3.5 to 20 threads/cm and having a titer of at least 420 dtex, and a second set of threads comprising 0.5 to 8 threads/cm and having a titer of at least 50 dtex, which second set of threads is transverse to the first set of threads, and wherein the ratio of the linear density of the first set of threads to the linear density of the second set of threads is >4.2, and the ratio of the number of threads/cm of the first set to that of the second set is >1, have improved ballistic properties.

DETAILED DESCRIPTION OF PREFERRED EMBODIMENTS

Preferably, the penetration-resistant material has a ratio of the linear density of the first set of threads to the linear density of the second set of threads >7.5. The number of threads in the first set of threads is 3.5 to 20 threads/cm. More preferably, the number is 4 to 15 threads/cm, and most preferably 5 to 12 threads/cm. The number of threads in the second set of threads is 0.5 to 8 threads/cm. More preferably, the number is 1 to 6 threads/cm, and most preferably 2 to 4 threads/cm. For reasons of efficient manufacturing it is preferred that the first set of threads is of warp threads and the second set of threads is weft threads. The second set of threads is transverse to the first set of threads. Although usually these sets are about perpendicular to each other, this is not necessary. The second set of threads may be provided under at angle other than 90° to the first set of threads.

The penetration-resistant material also consists of a second set of threads (preferably weft threads), the yarn composition of which is not decisive for the present invention. Preferably, however, these threads have high strength and high modulus. This is particularly the case when these threads are selected from polyester, polyethylene, polypropylene, polyamide, and aramid yarn. Most preferably, the second set of threads is made of polyester yarn. The first set of threads (preferably warp threads) is of high strength and high modulus, and most preferably aramid yarn is selected, more particularly paramid. Most preferred is poly para-phenyleneterephthalamide (PPTA). In a preferred embodiment the warp and weft threads are selected to be made of different polymers, for instance, a fabric having warp threads of p-aramid yarn and weft threads of polyester yarn is preferred.

As long as the required linear density ratio is satisfied, the linear density of the first set of threads is selected to be at least about 420 dtex, preferably between 420 and 3360 dtex, more preferably between 420 and 1680 dtex, and most preferably between about 840 and 1100 dtex. The linear density of the second set of threads is selected to be at least about 50 dtex, more preferably between 50 and 280 dtex, and most preferably between about 80 and 140 dtex.

The term "thread" means any sort of thread such as staple yarn, twisted staple yarn, twisted filament yarn, non-twisted intermingled yarn, and preferably, untwisted filament yarn.

In a preferred embodiment the threads of each of the two fabric layers of the double layer are bonded together, for instance, by stitch bonding, or preferably, with an adhesive material. The adhesive material may be adhesive material provided onto the threads or onto the fabric, for instance, as a finish. The adhesive material can also be an adhesive layer provided between the two fabric layers of the double layer. Adhesive materials include thermoplastic, elastomeric, and thermoset materials. It is also possible to use for at least part of the second set of threads a material that melts under pressure and/or heating, thereby accomplishing binding the threads of the first set of threads to those of the second set of threads, and optionally also binding the two fabric layers together. Thermoplastic materials include polyolefins such as polyethylene and polypropylene, polyamide, polyester, or mixtures of these materials. Elastomeric materials include Kraton, rubber, silicon, and the like. Thermoset materials include epoxy resins, polyester resins, phenolic resins, vinyl ester resins, and the like.

In another preferred embodiment at least one of the outer sides of the penetration-resistant material is provided with a protective layer. The protective layer can be a thermoplastic or an elastomeric material, or a mixture of these materials. The protective layer is applied to protect the fabric from damage by excessive abrasion.

The penetration-resistant material comprises at least one double layer consisting of two layers of woven fabric which are cross-plied at an angle and optionally bonded together. The term woven includes all types of weaves, such as plain weave, satin weave, basket weave, twill weave, and the like. Preferred fabrics are plain woven.

The penetration-resistant material may contain as little as one double layer consisting of two layers of woven fabric, but usually more double layers are applied. Suitable numbers of double layers are 5 to 100, and most preferably 6 to 35 double layers are used. In at least one of the double layers the two fabric layers are secured together at an angle. Preferred angles are 30 to 90°. An angle of about 90° is most preferred. For soft armor the best performance is usually obtained when the fabric layers in all double layers are secured at an angle, preferably an angle of 90°. The first set of threads of the first fabric layer of a double layer may be parallel to, or at an angle to, the first set of threads of the first fabric layer of the adjacent double layer.

The double layers are secured together using an adhesive layer or by stitching. Such an adhesive layer may be made of the previously mentioned materials for the adhesive materials and has a thickness between 4 and 36$\mu$, preferably between 8 and 20$\mu$.

Methods of manufacture of the double layers are well known in the art. Usually the fabric is made by warping the warp yarn on a beam, followed by weaving on a loom. The single layer may optionally be impregnated or laminated, and be subjected to a calandering process. At least two fabric layers can be bonded together, preferably at an angle to each other, by stitching, heating, or applying pressure.

The invention pertains also to articles like bulletproof vests and armor plates made of the above-mentioned woven fabric according to methods known to the skilled man.

The invention is further illustrated with the following examples.

EXAMPLE 1

Construction I was prepared according to this invention. The construction contained 21 double layers of an about 100 g/m$^2$ fabric made from Kevlar® 1100 dtex (ex DuPont) in warp (8.6 threads/cm) and polyester 140 dtex (Trevira®710, ex Hoechst) in weft direction (2 threads/cm) The warp /weft ratio is 7.9 . The layers were laminated together with 2 plies of a polyethylene film (LDPE, ex EKB) having a thickness of 10$\mu$. The total weight of construction I was about 4300 g/m$^2$.

Construction II was prepared according to this invention and contained 20 double layers of the same fabric as used for construction I, and 1 sheet of polyethylene film (LDPE, ex EKB) having a thickness of 10$\mu$ on both outer sides of the double layer and in between each of the two fabric layers of the double layer. The total weight of construction II was about 4400 g/m$^2$. $V_{50}$ values were determined with 9×19 Para Type DM 11A1B2 bullets, wherein $V_{50}$ is the velocity at which 50% of the bullets is stopped and 50% of the bullets gives full penetration. It was found that $V_{50}$ of construction I is 471 m/s and that $V_{50}$ of construction II is 481 m/s.

EXAMPLE 2

Construction III was made analogously to construction I with 19 plies of Twaron® 930 dtex (CT 709 Microfilament, ex Akzo Nobel) rather than Kevlar (10.4 warp threads/cm, 2 weft threads/cm, warp/weft ratio 6.6). The total weight of construction III was about 4330 g/m$^2$, the $V_{50}$ (determined with 9×19 Para Type DM 11A1B2 bullets) was about 490 m/s.

Comparative Example 3

Construction IV was made from 22 plies of Twaron® fabric style CT 709 (ex Akzo Nobel). Warp and weft threads were made from Twaron® 930 dtex Microfilament (ex Akzo Nobel) (10.5 threads/cm in warp and weft direction; warp/weft ratio 1). The total weight of construction IV was about 4400 g/m$^2$ , the $V_{50}$ (determined with 9×19 Para Type DM 11 A 1B2 bullets) was about 460–465 m/s.

EXAMPLE 4

Construction V was made from 50 double layers of a fabric made from Twaron® 930 dtex (9,5 threads/cm in warp direction and 2 threads/cm of Trevira 710 140 dtex in weft direction; warp/weft ratio 6.6).

The layers where laminated together with an LDPE-copolymer matrix (resin content 35%) at a temperature of 115° C. and a pressure of 2.5 MPa. The total weight was 6500 g/m$^2$, the $V_{50}$ (determined with 0.357 Magnum FJ CB SC bullets) was 484 m/s.

Comparative Example 5

Construction VI was made from 44 layers of Twaron® CT 709 fabric (930 dtex, 200 g/m$^2$, plain woven). The material was coated with PVB-modified phenolic resin (resin content 23%) and laminated at a temperature of 160° C. and a pressure of 1.0 MPa. The total weight was 10800 g/m$^2$, the $V_{50}$ (determined with 0.357 Magnum FJ CB SC bullets) was 487 m/s.

By using the above mentioned resin system, resin content, and laminating conditions, the weight could not be reduced without reducing $V_{50}$.

What is claimed is:

1. A penetration-resistant material comprising:

at least a double layer of fabric comprising two layers of woven fabric which are cross-plied at an angle, wherein the woven fabric is comprised of a first set of threads comprising 3.5 to 20 threads/cm and having a linear density of at least 420 dtex, and a second set of threads comprising 0.5 to 8 threads/cm and having a linear density of at least 50 dtex, with the second set of threads being transverse to the first set of threads, and wherein a ratio of the linear density of the first set of threads to the linear density of the second set of threads is >4.2, and a ratio of the number of threads/cm of the first set to the number of threads/cm of the second set is >1.

2. The penetration-resistant material according to claim 1, wherein the two layers of the double layer are bond together.

3. The penetration-resistant material according to claim 1, wherein the ratio of the linear density of the first set of threads to the linear density of the second set of threads is >7.5.

4. The penetration-resistant material according to claim 1, wherein the first set of threads comprises aramid threads.

5. The penetration-resistant material according to claim 1, wherein the second set of threads is polyester, polyethylene, polypropylene, or aramid yarn.

6. The penetration-resistant material according to claim 1, wherein the first set of threads comprises aramid threads and the second set of threads comprises polyester threads.

7. The penetration-resistant material according to claim 1, wherein the linear density of the first set of threads is 420 to 3360 dtex.

8. The penetration-resistant material according to claim 1, wherein the linear density of the second set of threads is 50 to 280 dtex.

9. The penetration-resistant material according to claim 1, wherein the first set of threads is warp threads and the second set of threads is weft threads.

10. The penetration-resistant material according to claim 1, wherein at least one outer side of the material is provided with a protective layer.

11. An article comprising the penetration-resistant material according to claim 1.

12. The penetration-resistant material according to claim 1, wherein the linear density of the first set of threads is 420 to 1680 dtex.

13. The penetration-resistant material according to claim 1, wherein the linear density of the first set of threads is 840 to 100 dtex.

14. The penetration-resistant material according to claim 1, wherein the linear density of the second set of threads is 80–140 dtex.

15. The penetration-resistant material according to claim 2, wherein the two layers of the double layer are bonded together with an adhesive material.

16. The penetration-resistant material according to claim 1, comprising a total of about 5 to about 100 of the double layers.

17. The penetration-resistant material according to claim 1, wherein the two layers of woven fabric are cross-plied at an angle of about 30 to about 90 degrees.

* * * * *

UNITED STATES PATENT AND TRADEMARK OFFICE

CERTIFICATE OF CORRECTION

PATENT NO. : 6,610,618 B1 
DATED : August 26, 2003
INVENTOR(S) : Christian Böttger et al.

It is certified that error appears in the above-identified patent and that said Letters Patent is hereby corrected as shown below:

Column 1,
Line 7, -- 1. Field of the Invention -- should be inserted.
Line 13, "DESCRIPTION OF THE RELATED ART" should be -- 2. Description of the Related Art --.

Column 2,
Line 14, "paramid" should be -- p-aramid --.

Column 4,
Line 43, "bond" should be -- bonded --.

Signed and Sealed this

Sixteenth Day of December, 2003

JAMES E. ROGAN
*Director of the United States Patent and Trademark Office*